US010087056B2

(12) United States Patent
Hartmann et al.

(10) Patent No.: US 10,087,056 B2
(45) Date of Patent: Oct. 2, 2018

(54) FREE-FALL WINCH WITH A SERVICE AND HOLDING BRAKE

(71) Applicant: Zollern GmbH & Co. KG, Sigmaringendorf-Laucherthal (DE)

(72) Inventors: Roland Hartmann, Bingen (DE); Albert Pfeiffer, Hohentengen (DE)

(73) Assignee: Zollern GmbH & Co. KG, Sigmaringendorf-Laucherthal (DE)

( * ) Notice: Subject to any disclaimer, the term of this patent is extended or adjusted under 35 U.S.C. 154(b) by 343 days.

(21) Appl. No.: 14/958,296

(22) Filed: Dec. 3, 2015

(65) Prior Publication Data

US 2016/0159626 A1 Jun. 9, 2016

(30) Foreign Application Priority Data

Dec. 5, 2014 (EP) ..... 14196525

(51) Int. Cl.

| | |
|---|---|
| ***B66D 1/22*** | (2006.01) |
| ***B66D 5/00*** | (2006.01) |
| ***B66D 1/14*** | (2006.01) |
| ***B66D 5/14*** | (2006.01) |
| ***B66D 1/12*** | (2006.01) |

(52) U.S. Cl.

CPC ..... *B66D 5/00* (2013.01); *B66D 1/12* (2013.01); *B66D 1/14* (2013.01); *B66D 1/22* (2013.01); *B66D 5/14* (2013.01)

(58) Field of Classification Search

CPC ... B66D 1/22; B66D 1/70; B66D 5/14; B66D 5/22

See application file for complete search history.

(56) References Cited

U.S. PATENT DOCUMENTS 3,572,482 A 3/1971 Kalpas
3,627,087 A * 12/1971 Eskridge ..... B66D 1/22 188/134

(Continued)

FOREIGN PATENT DOCUMENTS

DE 3935114 A1 * 5/1990 ..... B60K 17/046
DE 4134722 A1 4/1993
WO WO 2014/114440 A1 7/2014

OTHER PUBLICATIONS

European Partial Supplementary Search Report dated May 12, 2015 for European Patent Application No. 14196525.1.

*Primary Examiner* — Emmanuel M Marcelo
(74) *Attorney, Agent, or Firm* — McCarter & English, LLP

(57) ABSTRACT

A winch is provided that includes a frame and a winch drum mounted for rotation relative to the frame; a gearing via which the winch drum can be rotated by a drive motor attached to the winch, wherein the gearing includes a gear shaft; a first brake that includes a first brake body and a second brake body which is non-rotationally connected to the gear shaft. The first and second brake bodies can be pressed against each other in order to achieve a braking effect based on frictional engagement. A second brake is also provided that includes a third brake body and a fourth brake body which is non-rotationally connected to the gear shaft and/or the second brake body. The third and fourth brake bodies can be pressed against each other in order to achieve a braking effect based on frictional engagement.

19 Claims, 2 Drawing Sheets

(56) References Cited

U.S. PATENT DOCUMENTS

2008/0230332 A1* 9/2008 Iwai ..... F16D 65/092
188/250 B
2009/0114892 A1* 5/2009 Lesko ..... B66D 1/22
254/342
2011/0297495 A1* 12/2011 Hanna ..... F16D 65/10
188/218 R
2012/0152668 A1* 6/2012 Santamaria Razo .....
F16D 65/0006
188/251 R
2013/0112515 A1* 5/2013 Shinagawa ..... F16D 65/12
188/218 XL
2014/0109723 A1* 4/2014 Ishimoto ..... C22C 9/00
75/231
2015/0292582 A1* 10/2015 El-Wardany ..... B66B 5/22
188/250 G
2015/0308532 A1* 10/2015 Kobune ..... F16D 69/026
188/251 A
2015/0369315 A1* 12/2015 Wall ..... F16D 65/12
188/18 A

* cited by examiner

FREE-FALL WINCH WITH A SERVICE AND HOLDING BRAKE

BACKGROUND

1. Technical Field

The invention relates to a winch, in particular a free-fall winch with a braking device which comprises a first brake for the service brake function and, in particular, for the holding brake function and a second brake for the holding brake function. The winch can for example be one which can be motor-driven, in particular a free-fall winch or a lifeboat winch.

2. Background Art

DE 41 34 722 A1 discloses a generic free-fall winch which comprises a winch drum which can be motor-driven via a gearing. The gearing comprises a gear shaft and a multi-disc brake comprising first discs and second discs, wherein the second discs are non-rotationally connected to the gear shaft. The second discs are non-rotationally connected to the housing. In free-fall operations, the rotation of the winch drum can be slowed by the first and second discs pressing against each other. Using the brake, the rotating winch drum can be slowed and/or the winch drum can be held non-rotationally relative to the housing. The proposed service brake thus also serves as a holding brake. The brake pads used in service brakes are normally selected so as to achieve comfortable braking. If the service brake is dimensioned such that it only performs its ordinary service brake function, there is a risk of creeping between the first and second discs, i.e. a risk of rotation, however slow, between the first and second discs, when the service brake is used as a holding brake. In order to prevent this, the service brakes proposed in the prior art are oversized to such an extent that creeping is prevented. Because the brake is oversized, it requires a correspondingly larger design space, which compromises the compactness of the winch.

It is an object of the invention to provide a winch, in particular a free-fall winch, which allows a compact design.

SUMMARY

The object noted above is solved by a winch, in particular a free-fall winch, as disclosed herein. The disclosed winch comprises: a frame, which can also be referred to or embodied as a winch frame or a housing; and a winch drum which is mounted, preferably by the frame, such that it can be rotated relative to the frame. A cable, in particular a steel cable, a chain or a belt can be wound around the circumference of the winch drum. A free-fall winch for a cable can optionally be a free-fall cable winch.

The winch comprises a gearing, such as for example a single-stage or multi-stage planetary gear, via which the winch drum can be rotated by means of a drive motor which is or can be attached to the winch. The drive shaft of the drive motor can be coupled to the winch drum via the gearing. The gearing comprises a gear shaft which is coupled to the winch drum such that a rotation of the winch drum relative to the frame can generate a rotation of the gear shaft relative to the frame, in particular at a rotational speed which is different to the rotational speed of the winch drum.

The winch comprises a first brake which preferably serves as a service brake. The first brake can for example be a multi-disc brake. The first brake comprises at least one first brake body and at least one second brake body which is non-rotationally connected to the gear shaft. Multiple first discs can for example form the first brake body, and multiple second discs can form the at least one second brake body. The at least one first brake body and the at least one second brake body can be pressed against each other, in order to achieve a braking effect based on a frictional engagement, in particular by means of a pressure piece of the first brake. The at least one first brake body can for example be non-rotationally or permanently non-rotationally connected to the frame, in particular directly or indirectly, i.e. via other components. The at least one second brake body can be non-rotationally, in particular permanently non-rotationally, connected to the gear shaft, directly or indirectly, i.e. via other components. When the gear shaft is rotated, in particular relative to the frame, the at least one second brake body can be rotated relative to the at least one first brake body and/or relative to the frame.

In accordance with the invention, the winch comprises a second brake which comprises at least one third brake body and at least one fourth brake body which is non-rotationally connected to the gear shaft and/or the at least one second brake body. The second brake can in particular serve as a holding brake together with the first brake and/or can be a multi-disc brake. Multiple third discs can form the at least one third brake body, wherein multiple fourth discs can form the at least one fourth brake body. The at least one fourth brake body can be directly or indirectly and in particular permanently connected to the gear shaft. The at least one fourth brake body is preferably connected to the at least one second brake body indirectly, in particular via the gear shaft. The at least one third brake body can in particular be permanently non-rotationally connected, indirectly or directly, to the frame and/or the first brake body. The at least one third brake body and the at least one fourth brake body can be pressed against each other, in order to achieve a braking effect based on a frictional engagement, in particular by means of a pressure piece of the second brake. When the gear shaft is rotated, in particular relative to the frame, the at least one fourth brake body can be rotated relative to the at least one third brake body and/or relative to the frame.

Having two brakes acting on the gear shaft results in the advantage that both brakes can be dimensioned to be small, since the first brake does not have to be oversized and the second brake only needs to be configured such that it prevents the first brake from creeping when the first brake and the second brake are applied for the holding brake function.

The first brake can in particular be configured such that its maximum braking torque is less than the braking torque required for a holding brake function, in relation to the maximum permissible load torque, wherein the second brake can be configured such that its maximum braking torque is less than the braking torque required for the holding brake function, in relation to the maximum permissible load torque, wherein the sum of the maximum braking torque of the first brake and the maximum braking torque of the second brake is greater than or equal to the braking torque required for the holding brake function, in relation to the maximum permissible load torque. Thus, it is only necessary to use the first brake in order to slow the winch (the service brake function), wherein the first brake and second brake are used, in particular applied, for fixing the winch in relation to the frame, in order to achieve the braking torque required for the holding brake function. The second brake is embodied to be too weak, in and of itself, for a holding brake function, such that it can only perform the holding brake function in conjunction with the first brake. The same applies analogously to the first brake, i.e. the first brake is configured to be too weak for the holding brake function and can only perform the holding brake function in conjunction with the second brake.

This advantageously results in an operating method for the winch described herein, according to which the winch drum which is rotated relative to the frame, and/or the gear shaft, is slowed by means of the first brake and in particular only the first brake, while the second brake is released. Before or after the winch drum and/or the gear shaft is slowed by means of the first brake, the winch drum and/or the gear shaft can be fixed, i.e. secured against rotating, in relation to the frame by applying the first brake and the second brake. If, for example, the winch drum or the gear shaft is secured against rotating in relation to the frame by means of the first brake before it is slowed, the second brake can be released and the first brake can be at least partially released, in order that the winch drum and the gear shaft can be rotated relative to the frame for free-fall operations, wherein at the end of free-fall operations, the winch drum or the gear shaft is slowed to a stop or almost to a stop by means of the first brake, and the second brake is applied in order to fix the winch drum and/or the gear shaft relative to the frame.

The friction pairing, in particular material pairing, between the at least one first brake body and the at least one second brake body can in particular differ from the friction pairing, in particular material pairing, between the at least one third brake body and the at least one fourth brake body. A friction pairing or material pairing which is typically selected for a service brake can advantageously be selected for the first brake, while a friction pairing or material pairing which is typically used in a holding brake can be selected for the second brake.

For the friction pairing, in particular material pairing, between the at least one first brake body and the at least one second brake body, it preferably holds that: $\mu_{static} \leq \mu_{dynamic}$, where $\mu_{static}$ denotes the coefficient of static friction (stiction) and $\mu_{dynamic}$ denotes the coefficient of dynamic friction (sliding friction). This relationship between the friction coefficients enables comfortable service braking, since the braking torque does not abruptly rise at the transition from sliding friction to stiction, which would cause a noticeable jolt.

For the friction pairing, in particular material pairing, between the at least one third brake body and the at least one fourth brake body, it preferably holds that: $\mu_{static} > \mu_{dynamic}$, where static denotes the coefficient of static friction (stiction) and $\mu_{dynamic}$ denotes the coefficient of dynamic friction (sliding friction). This relationship between the friction coefficients enables creeping and/or rotation of the at least one fourth brake body relative to the at least one third brake body to be prevented.

The at least one first brake body, in particular the first discs, can comprise a first brake pad made of an organic material, or the at least one second brake body, in particular the second discs, can comprise a second brake pad made of an organic material.

A friction pairing of a metal (such as for example steel) and an organic material (such as for example paper) between the first brake body and the second brake body is preferred. One of the first brake body, in particular the first discs, and the second brake body, in particular the second discs, can comprise a brake pad made of an organic material, such as for example a paper covering, while a metallic material, in particular steel, forms a friction surface for the brake pad made of organic material on the other of the first brake body and the second brake body. This forms the friction pairing of a metal and an organic material. The at least one first brake body, in particular the first discs, can comprise a first brake pad made of an organic material, and the at least one second brake body can comprise a metallic material, in particular steel, which forms the friction surface for the organic material. Alternatively, the at least one second brake body, in particular the second discs, can comprise a second brake pad made of an organic material, and the at least one first brake body can comprise a metallic material, in particular steel, which forms the friction surface for the organic material.

The at least one third brake body, in particular the third discs, can comprise a third brake pad made of a sintered material, or the at least one fourth brake body, in particular the fourth discs, can comprise a fourth brake pad made of a sintered material.

A friction pairing of a metal (such as for example steel) and a sintered material (such as for example a sintered metal, in particular sintered bronze) between the third brake body and the fourth brake body is preferred. One of the third brake body, in particular the third discs, and the fourth brake body, in particular the fourth discs, can comprise a brake pad made of a sintered material, such as for example sintered bronze, while a metallic material, in particular steel, forms a friction surface for the brake pad made of sintered material on the other of the third brake body and the fourth brake body. This forms the friction pairing of a metal and a sintered material. The at least one third brake body, in particular the third discs, can comprise a third brake pad made of a sintered material, and the at least one fourth brake body can comprise a metallic material, in particular steel, which forms the friction surface for the sintered material. Alternatively, the at least one fourth brake body, in particular the fourth discs, can comprise a fourth brake pad made of a sintered material, and the at least one third brake body can comprise a metallic material, in particular steel, which forms the friction surface for the sintered material.

In embodiments which develop the invention, the at least one first brake body and the at least one second brake body can be arranged in an oil bath. This improves the heat dissipation from the at least one first brake body and second brake body which rub against each other and reduces the wear on the at least one first brake body and the at least one second brake body.

The at least one third brake body and the at least one fourth brake body can likewise be arranged in an oil bath or alternatively can run dry, i.e. not be arranged in an oil bath. Since the second brake only serves as a holding brake, no significant generation of heat is to be expected between the at least one third brake body and the at least one fourth brake body.

The force with which the at least one first brake body and the at least one second brake body are pressed against each other can for example be varied, in particular in multiple stages such as for example three stages or non-incrementally, in particular when the second brake is released, i.e. the first brake can be controlled independently of the second brake when the second brake is released. When the second brake is applied, a controller can in particular provide for the first brake to likewise be applied. When the second brake is released, the at least one first brake body and the at least one second brake body can be pressed against each other independently of the at least one third brake body and the at least one fourth brake body, in particular in multiple stages such as for example at least two, at least three or even more stages or non-incrementally, thus enabling the braking torque of the second brake, in particular the service brake, to be adjusted.

In preferred embodiments, the first brake can comprise at least one biased spring, such as for example multiple biased springs, wherein the at least one biased spring presses the at least one first brake body and the at least one second brake body against each other via a pressure piece for the purpose of braking. The maximum braking torque of the brake is thus determined by the at least one biased spring which presses the brake bodies against each other. The pressure piece can be electrically, hydraulically or pneumatically moved, counter to the force of the biased spring(s), in order to release the first brake or reduce the braking torque. This ensures that the at least one biased spring presses the first and second brake bodies against each other via the pressure piece in order to generate the maximum braking torque if the means for moving the pressure piece counter to the force of the biased spring(s) fails. This provides a safety device which ensures that the first brake brakes when the moving means fails. The same applies analogously to the second brake, i.e. the second brake comprises at least one biased spring which presses the at least one third brake body and the at least one fourth brake body against each other via a pressure piece for the purpose of braking. In this case, too, the pressure piece can be able to be electrically, hydraulically or pneumatically moved, counter to the force of the biased springs, in order to release the second brake or reduce the braking torque.

The respective pressure piece of the first and/or second brake can for example form a shifting wall of a pressure chamber which can be pneumatically or hydraulically pressurised in order to shift the pressure piece counter to the force of the at least one spring, i.e. to shift the pressure piece such that the at least one spring is tensed. When the pressure chamber is evacuated, the spring can shift the pressure piece and press it against the brake bodies.

The winch can optionally comprise a second gear shaft which is or can be non-rotationally connected to the drive shaft of the motor or which is the drive shaft of the motor. The second gear shaft can for example be flush with the aforementioned gear shaft, which can be referred to as the first gear shaft in order to better distinguish it. The second gear shaft can be fixed relative to the frame by means of an additional brake, for example a holding brake which is in particular configured as a multi-disc brake, in particular during free-fall operations, and can be released relative to the frame for the purpose of rotation, in particular during motorised lifting or lowering operations. The additional brake is preferably applied when the second brake is released and the first brake is at least partially released (free-fall operations). The additional brake is preferably released when the first brake and second brake are applied (motorised lifting or lowering operations). It is optionally possible for the additional brake and the first brake and second brake to be applied (holding function or emergency shutdown).

BRIEF DESCRIPTION OF THE FIGURES

The invention has been described on the basis of multiple preferred embodiments. In the following, a particularly preferred embodiment is described on the basis of figures. The features thus disclosed, each individually and in any combination of features, advantageously develop the subject-matter of the invention. There is shown.

DESCRIPTION OF EXEMPLARY EMBODIMENT(S)

Figure 1:
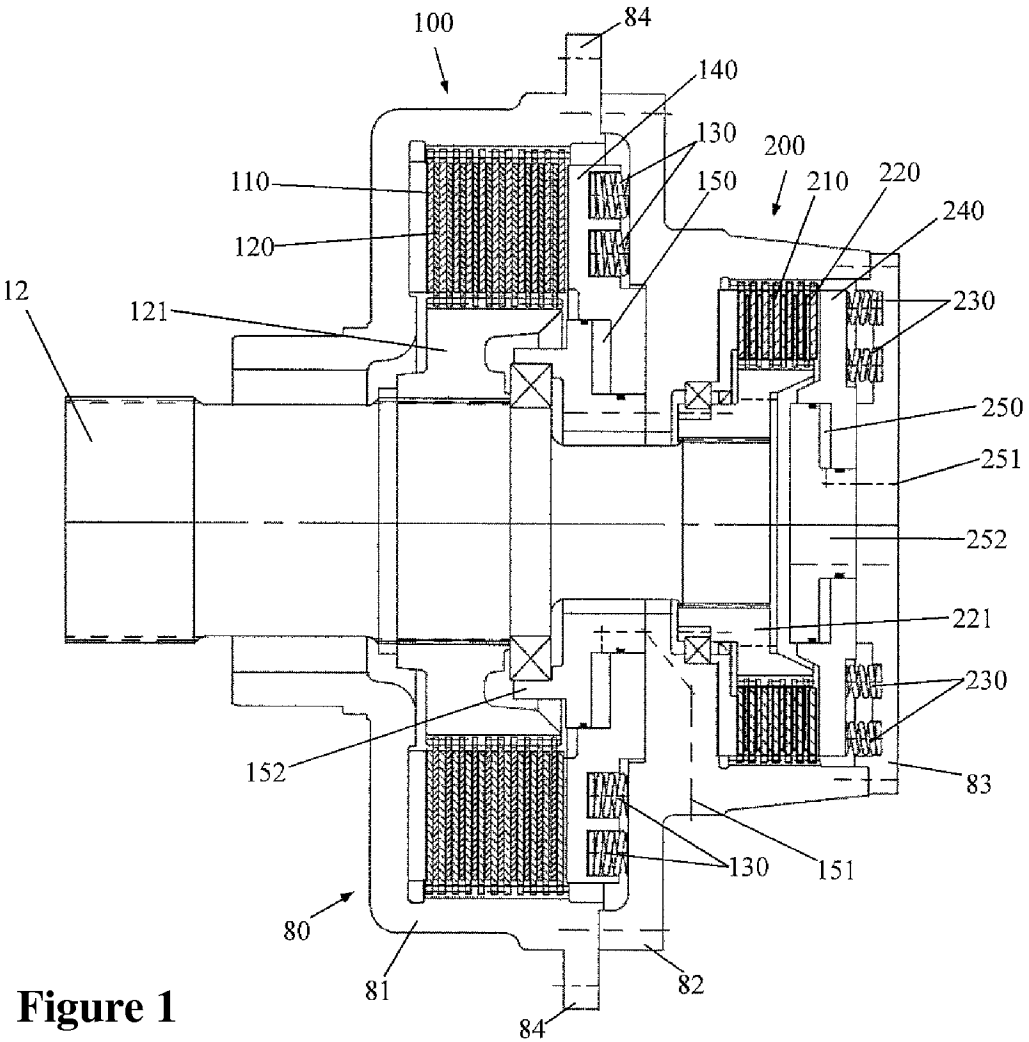
FIG. 1 a cross-sectional view of a sub-assembly, comprising a first brake and a second brake, for a winch in accordance with the invention.
Figure 2:
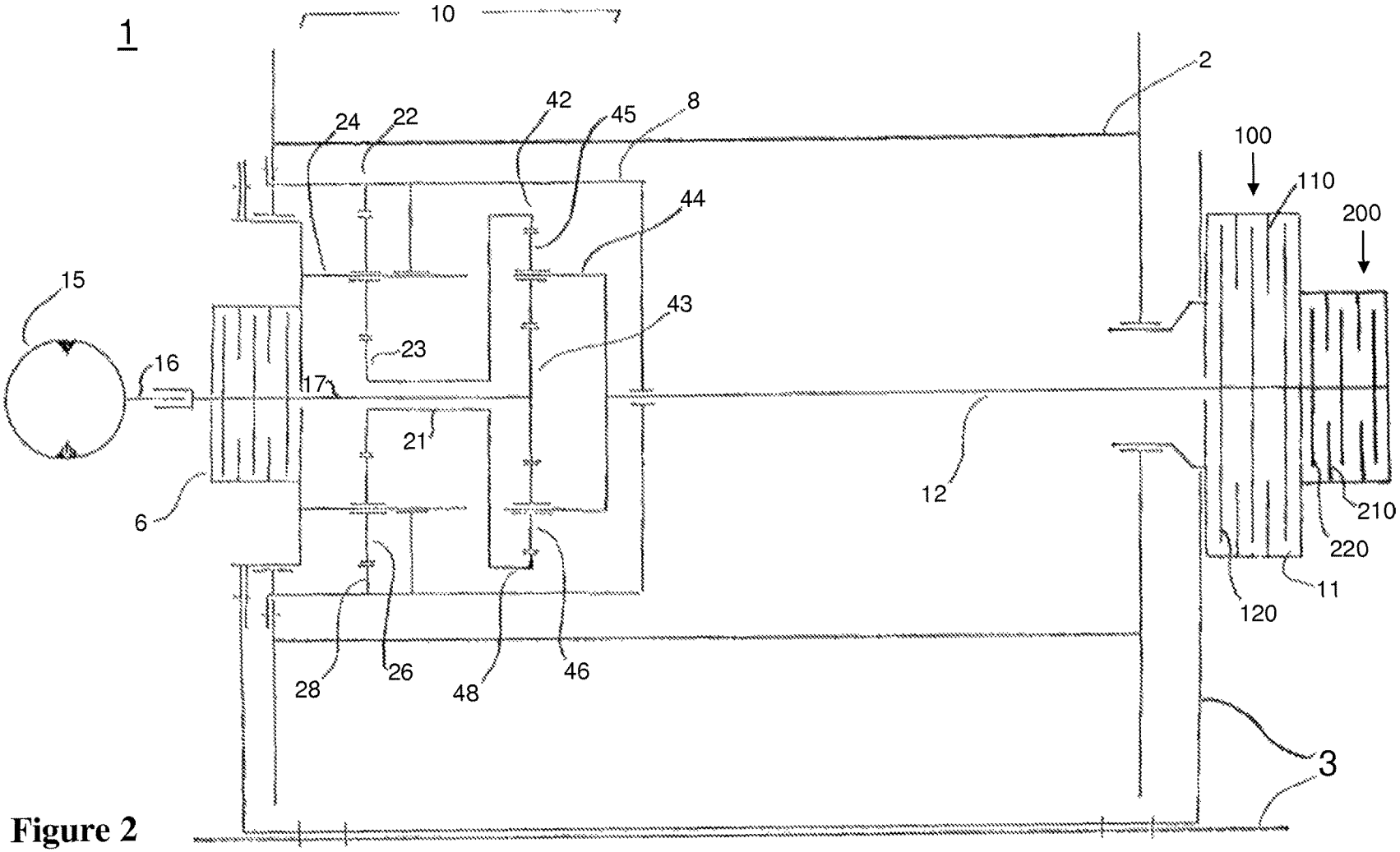
FIG. 2 a schematic diagram of a winch in which in particular the sub-assembly from FIG. 1 can be installed or contained.

The operation of an exemplary free-fall winch 1 shall firstly be described on the basis of the diagram from FIG. 2. The sub-assembly from FIG. 1 can be contained in this free-fall winch 1.

The free-fall winch 1 comprises a winch drum 2, wherein a cable (not shown) is or can be wound around the circumference of the winch drum 2. A multi-stage planetary gear—in this example, a two-stage planetary gear 10—is arranged within the winch drum 2, in particular in a housing cup 8 which is in turn situated in the winch drum 2 with which it is connected, rotationally rigid. The winch drum 2 is mounted, such that it can be rotated, in the frame 3 which can also be referred to as the housing. A drive motor 15 drives a sun wheel 43 of a drive planetary stage 42 via its drive shaft 16 and a second gear shaft 17. The rotational movement of the sun wheel 43 is transmitted onto the sun wheel 23 of a driven planetary stage 22 via a hollow wheel 48 of the drive planetary stage 42. For this purpose, the sun wheel 23 is connected to the hollow wheel 48 via a hollow shaft 21, within which for example the second gear shaft 17 is arranged. The rotational movement of the sun wheel 23 is transmitted onto the hollow wheel 28 of the driven planetary stage 22 via the planetary wheels 26, wherein the hollow wheel 28 is connected, rotationally rigid, to the housing cup 8 and/or connected in general terms to the winch drum 2. An additional planetary stage, which further reduces the rotational speed from the motor 15 to the winch drum 2, can optionally be arranged between the drive planetary stage 42 and the driven planetary stage 22. The planetary wheels 26 of the driven planetary stage 22 absorb the reaction forces of the winch drum as a result of being supported against the frame 3. The planetary carrier 44 of the drive planetary stage 42 is connected, in particular non-rotationally, to a first gear shaft 12, wherein the gear shaft 12 is mounted such that it can be rotated relative to the housing cup 8 of the planetary gear 10 and the frame 3 of the free-fall winch 1. A first brake 100 which is fixedly connected to the winch frame 3, and a second brake 200 which is fixedly connected to the winch frame 3, are arranged on the gear shaft 12. The first brake 100 serves as a service brake for slowing the load in free-fall operations. The second brake 200 serves, in conjunction with the first brake 100, as a holding brake for securely fixing the winch drum 2 in relation to the frame 3.

Optionally, a second drive motor (not shown) could for example be fastened to the gear shaft 12, wherein the second drive motor drives the planetary carrier 44 of the drive planetary stage 42 via the gear shaft 12. The drive planetary stage 42 then transmits the transmitting rotational movements of the two drive motors onto the sun wheel 23 of the driven planetary stage 22, by means of its hollow wheel 48. As an alternative to the embodiment shown in FIG. 2, the planetary carrier 44 can be non-rotationally connected to the sun wheel 23 via the hollow shaft 21. The hollow wheel 48 of the drive planetary stage 42 can then be non-rotationally connected to the gear shaft 12. In this alternative, the hollow shaft 21 of the drive planetary stage 42 is the stay (free member) which cannot be driven but which can be braked relative to the winch frame 3 by the free-fall brake 100, 200.

The gear shaft 17 which is non-rotationally connected to the sun wheel 43 comprises a holding brake 6 which is fastened to the gear shaft 17 on the one hand and to the winch frame on the other, such that the gear shaft 17 can be fixed in relation to the winch frame 3, in particular during free-fall operations, i.e. the brake 6 is released during lifting and lowering operations by means of the motor 15, wherein the first and second brake 100, 200 are applied, such that the winch drum 2 can perform lifting and/or lowering movements in relation to the winch frame 3 by means of the motor 15. The holding brake 6 is applied for free-fall operations, wherein the second brake 200 is released and the first brake 100 is likewise at least partially released, such that the winch drum 2 is set in motion in relation to the frame 3. The rotational velocity of the winch drum 2 can be regulated by means of the braking torque of the first brake 100.

For the drive planetary stage 42, the sun wheel 43 of which can be driven by the motor 15, it is conceivable in one variant for the sun wheel 23 of the driven planetary stage 22 to be able to be driven by the planetary carrier 44 of the drive planetary stage 42 (not shown in FIG. 2), wherein the gear shaft 12 can be driven by the hollow wheel 48 of the drive planetary stage 42. In the variant shown in FIG. 2, the sun wheel 23 of the driven planetary stage 22 can be driven by the hollow wheel 48 of the drive planetary stage 22, wherein the gear shaft 12 can be driven by the planetary carrier 44 of the drive planetary stage 42.

In one variant, deviating from FIG. 2 in which the planetary carrier 24 is non-rotationally connected to the winch frame 3, the planetary carrier 24 can be non-rotationally connected to the winch drum 2, wherein the hollow wheel 28 is non-rotationally connected to the winch frame 3.

As can be seen from FIGS. 1 and 2, the first brake 100 is a multi-disc brake, and the second brake 200 is likewise a multi-disc brake.

As can best be seen from FIG. 1, the first brake 100 comprises multiple first discs 110 which are non-rotationally connected to a housing 80 of the sub-assembly from FIG. 1. The sub-assembly from FIG. 1 can be fixedly connected to the winch frame 3 via its housing 80, in particular via the flanges 84, such that the housing 80 can be regarded as part of the winch frame 3. The housing 80 comprises a first housing cup 81, a second housing cup 82 and a cover 83, as well as an inner piece 152 and an inner piece 252.

The first brake 100 comprises a disc carrier 121 which is non-rotationally connected to the gear shaft 12. The first brake 100 comprises multiple second discs 120 which are non-rotationally connected to the disc carrier 121 or are non-rotationally connected to the gear shaft 12 via the disc carrier 121. One second disc 120 is arranged between each two first discs 110, and one first disc 110 is arranged between each two second discs 120. The first and second discs 110, 120 can be pressed against each other via a first pressure piece 140 of the brake 100, thus enabling the friction between the discs 110, 120 and therefore the braking torque of the first brake 100 to be generated or increased. The pressure piece 140 is pressed against the discs 110, 120 by means of biased springs 130. The springs 130 thus generate the pressing force on the discs 110, 120 which is required for the braking torque. The at least one spring 130 is supported at one end on the pressure piece 140 and at the other end on the housing 80, in particular on the second housing cup 82. The at least one spring 130 is a coiled spring which acts as a pressure spring. The inner piece 152 and the pressure piece 140 form the walls of a first pressure chamber 150 which can be pressurised using a fluid, in particular pressurised air or hydraulic oil, via a channel 151. The housing 80, in particular the second housing cup 82, comprises a connector on its outer side for attaching a supply line for the channel 151. Feeding fluid into the chamber 150 enables the pressure piece 140 to be shifted such that the at least one spring 130 is tensed on the one hand, and the discs 110, 120 are relieved of the pressing force of the pressure piece 140, such that the braking torque of the brake 100 decreases. Dissipating fluid from the pressure chamber 150, in particular reducing the pressure in the pressure chamber 150, enables the at least one spring 130 to press the pressure piece 140 in order to increase the pressing force against the discs 110, 120, thus increasing the braking torque of the brake 100. The braking torque of the brake 100 can be adjusted in almost any way, i.e. non-incrementally, by correspondingly shifting the pressure piece 140 and/or pressurising the chamber 150 using fluid.

The inner piece 152 simultaneously forms the bearing seat for a roll bearing which mounts the gear shaft 12, such that it can be rotated, on the housing 80, wherein the roll bearing is supported at its outer circumference on the inner piece 152, and the gear shaft 12 is supported at its outer circumference on an inner circumference of the roll bearing.

A second brake 200, which acts as a holding brake, is provided in the housing 80, wherein the second brake 200 comprises multiple third discs 210 which are non-rotationally connected to the housing 80, in particular to the second housing cup 82. The second brake 200 comprises multiple fourth discs 220 which are non-rotationally connected to a disc carrier 221 and/or non-rotationally connected to the gear shaft 12 via the disc carrier 221. The disc carrier 221 is non-rotationally connected to the gear shaft 12. One third disc 210 is situated between each two fourth discs 220, and one fourth disc 220 is situated between each two third discs 210. The second brake 200 comprises a second pressure piece 240 which presses against the discs 210, 220 with a pressing force by means of multiple springs 230 or in general terms at least one spring 230 of the second brake 200. The pressure piece 240 is pressed against the discs 210, 220 with a pressing force via the at least one spring, for example a second spring 230, such that the required braking torque is generated. In order to release the brake, the pressure piece 240 is shifted counter to the force of the at least one spring 230, such that the at least one spring 230 is tensed by the pressure piece 240, and the discs 210, 220 are relieved of the pressing force. The second pressure piece 240 and the inner piece 252 which is fastened to the cover 251 form the walls of a second pressure chamber 250 to which fluid can be fed via a fluid channel 251. The channel 251 ports on the outer side of the housing 80, in particular the cover 83, namely into a connector to which a fluid line can be attached. Feeding fluid into the second pressure chamber 250 and/or increasing the pressure in the second fluid chamber 250 shifts the second pressure piece 240 counter to the force of the at least one spring 230, thus releasing the second brake 200.

The at least one spring 230 is supported at one end on the second pressure piece 240 and at the other end on the housing 80, in particular on the housing cover 83. The at least one spring 230 is a coiled spring which acts as a pressure spring.

The material pairing between the first and second discs 110, 120 differs from the material pairing between the third and fourth discs 210, 220. For the material pairing of the first and second discs 110, 120 in particular, it holds that: $\mu_{static} \leq \mu_{dynamic}$. For the material pairing between the third and fourth discs in particular, it holds that: $\mu_{static} > \mu_{dynamic}$.

The first brake 100 is configured such that its maximum braking torque is less than the braking torque required for a holding brake function. The braking torque required for the holding brake function relates to the maximum permissible load torque, which depends on the maximum permissible load on the cable. The second brake 200 is configured such that its maximum braking torque is less than the braking torque required for a holding brake function. Thus, neither of the brakes 100, 200 is dimensioned to be sufficient, in and of itself, to enable the maximum braking torque. The sum of the maximum braking torque of the first brake 100 and the maximum braking torque of the second brake 200 is however greater than or equal to the required braking torque for the holding brake function. This enables the first and second brake 100, 200 to be configured, in and of themselves, to be compact.

Although the present invention has been described with reference to exemplary embodiments thereof, the present invention is neither limited by or to such exemplary embodiments. Rather, the present invention may be implemented in various forms and with various modifications based on the disclosure herein, as will be readily apparent to persons skilled in the art.

The invention claimed is:

1. A winch, comprising:

a) a frame and a winch drum which is mounted such that it can be rotated relative to the frame;

b) a gearing via which the winch drum can be rotated by means of a drive motor which is or can be attached to the winch, wherein the gearing comprises a gear shaft;

c) a first brake which comprises at least one first brake body and at least one second brake body which is non-rotationally connected to the gear shaft, wherein the at least one first brake body and the at least one second brake body can be pressed against each other, in order to achieve a braking effect based on a frictional engagement; and d) a second brake which comprises at least one third brake body and at least one fourth brake body which is non-rotationally connected to at least one of the gear shaft and the at least one second brake body, wherein the at least one third brake body is non-rotationally connected to at least one of the frame and the at least one first brake body, and wherein the at least one third brake body and the at least one fourth brake body can be pressed against each other, in order to achieve a braking effect based on a frictional engagement.

2. The winch according to claim 1, wherein the first brake can be controlled independently of the second brake and wherein the at least one first brake body and the at least one second brake body can be pressed against each other independently of the at least one third brake body and the at least one fourth brake body.

3. The winch according to claim 1, wherein the at least one first brake body comprises a first brake pad made of an organic material and the at least one second brake body comprises a second brake pad made from metal.

4. The winch according to claim 1, wherein the at least one third brake body comprises a third brake pad made of a sintered material and the at least one fourth brake body comprises a fourth brake pad made from metal.

5. The winch according to claim 1, wherein the at least one first brake body and the at least one second brake body are arranged in an oil bath.

6. The winch according to claim 1, wherein for the friction pairing between the at least one first brake body and the at least one second brake body, it holds that: $\mu_{static} \leq \mu_{dynamic}$.

7. The winch according to claim 1, wherein for the friction pairing between the at least one third brake body and the at least one fourth brake body, it holds that: $\mu_{static} > \mu_{dynamic}$.

8. The winch according to claim 1, wherein the first brake is configured as a service brake and the second brake is configured as a holding brake.

9. The winch according to claim 1, wherein the first brake is configured such that its maximum braking torque is less than the braking torque required for a holding brake function, wherein the second brake is configured such that its maximum braking torque is less than the braking torque required for the holding brake function, and wherein the sum of the maximum braking torque of the first brake and the maximum braking torque of the second brake is greater than or equal to the required braking torque for the holding brake function.

10. The winch according to claim 1, wherein the first brake is a multi-disc brake, and wherein multiple first discs form the at least one first brake body, and multiple second discs form the at least one second brake body.

11. The winch according to claim 1, wherein the second brake is a multi-disc brake, and wherein multiple third discs form the at least one third brake body, and multiple fourth discs form the at least one fourth brake body.

12. The winch according to claim 1, wherein:

the first brake comprises at least one biased spring which presses the at least one first brake body and the at least one second brake body against each other via a pressure piece for the purpose of braking, wherein the pressure piece can be electrically, hydraulically or pneumatically moved, counter to the force of the biased spring, in order to release the first brake or reduce the braking torque.

13. A method for operating the winch according to claim 1, wherein the winch drum or gear shaft which is rotated relative to the frame is slowed by means of the first brake, while the second brake is released, and wherein the winch drum or gear shaft is previously or subsequently secured against rotating in relation to the frame by applying the first brake and the second brake.

14. The winch according to claim 1, wherein the at least one second brake body comprises a second brake pad made of an organic material and the at least one first brake body comprises a first brake pad made of metal.

15. The winch according to claim 1, wherein the at least one fourth brake body comprises a fourth brake pad made of a sintered material and the at least one third brake body comprises a third brake pad made from metal.

16. The winch according to claim 1, wherein the at least one third brake body and the at least one fourth brake body are arranged in an oil bath or run dry.

17. A winch, comprising:

a) a frame and a winch drum which is mounted such that it can be rotated relative to the frame;

b) a gearing via which the winch drum can be rotated by means of a drive motor which is or can be attached to the winch, wherein the gearing comprises a gear shaft;

c) a first brake which comprises at least one first brake body and at least one second brake body which is non-rotationally connected to the gear shaft, wherein the at least one first brake body and the at least one second brake body can be pressed against each other, in order to achieve a braking effect based on a frictional engagement; and d) a second brake which comprises at least one third brake body and at least one fourth brake body which is non-rotationally connected to at least one of the gear shaft and the at least one second brake body, wherein the at least one third brake body is non-rotationally connected to at least one of the frame and the at least one first brake body, and wherein the at least one third brake body and the at least one fourth brake body can be pressed against each other, in order to achieve a braking effect based on a frictional engagement;

wherein the second brake further comprises at least one biased spring which presses the at least one third brake body and the at least one fourth brake body against each other via a pressure piece for the purpose of braking, wherein the pressure piece can be electrically, hydraulically or pneumatically moved, counter to the force of the biased spring, in order to release the second brake or reduce the braking torque.

18. The winch, comprising:

a) a frame and a winch drum which is mounted such that it can be rotated relative to the frame;

b) a gearing via which the winch drum can be rotated by means of a drive motor which is or can be attached to the winch, wherein the gearing comprises a gear shaft;

c) a first brake which comprises at least one first brake body and at least one second brake body which is non-rotationally connected to the gear shaft, wherein the at least one first brake body and the at least one second brake body can be pressed against each other, in order to achieve a braking effect based on a frictional engagement; and d) a second brake which comprises at least one third brake body and at least one fourth brake body which is non-rotationally connected to at least one of the gear shaft and the at least one second brake body, wherein the at least one third brake body is non-rotationally connected to at least one of the frame and the at least one first brake body, and wherein the at least one third brake body and the at least one fourth brake body can be pressed against each other, in order to achieve a braking effect based on a frictional engagement;

wherein the gearing further comprises:

e) a driven planetary stage, e1) a sun wheel of which can be driven, e2) a planetary carrier or hollow wheel of which is non-rotationally connected to the frame, and e3) a remaining free member of which is non-rotationally connected to the winch drum; and f) a drive planetary stage, f1) a sun wheel of which can be driven by the motor, f2) wherein the sun wheel of the driven planetary stage can be driven by a planetary carrier of the drive planetary stage, and f3) wherein the gear shaft can be driven by a hollow wheel of the drive planetary stage.

19. A winch, comprising:

a) a frame and a winch drum which is mounted such that it can be rotated relative to the frame;

b) a gearing via which the winch drum can be rotated by means of a drive motor which is or can be attached to the winch, wherein the gearing comprises a gear shaft;

c) a first brake which comprises at least one first brake body and at least one second brake body which is non-rotationally connected to the gear shaft, wherein the at least one first brake body and the at least one second brake body can be pressed against each other, in order to achieve a braking effect based on a frictional engagement; and d) a second brake which comprises at least one third brake body and at least one fourth brake body which is non-rotationally connected to at least one of the gear shaft and the at least one second brake body, wherein the at least one third brake body is non-rotationally connected to at least one of the frame and the at least one first brake body, and wherein the at least one third brake body and the at least one fourth brake body can be pressed against each other, in order to achieve a braking effect based on a frictional engagement;

wherein the gearing further comprises:

e) a driven planetary stage (22), e1) a sun wheel (23) of which can be driven, e2) a planetary carrier (24) or hollow wheel (28) of which is non-rotationally connected to the frame (3), and e3) a remaining free member of which is non-rotationally connected to the winch drum (2); and f) a drive planetary stage (42), f1) a sun wheel (43) of which can be driven by the motor (15), f2) wherein the sun wheel (23) of the driven planetary stage (22) can be driven by a hollow wheel (48) of the drive planetary stage (42), and f3) wherein the gear shaft (12) can be driven by a planetary carrier (44) of the drive planetary stage (42).

* * * * *